US006664466B2

(12) United States Patent
Bailey

(10) Patent No.: US 6,664,466 B2
(45) Date of Patent: Dec. 16, 2003

(54) MULTIPLE SHIELDED CABLE

(75) Inventor: George R. Bailey, Gaithersburg, MD (US)

(73) Assignee: Spirent Communications of Rockville, Inc., Rockville, MD (US)

( * ) Notice: Subject to any disclaimer, the term of this patent is extended or adjusted under 35 U.S.C. 154(b) by 0 days.

(21) Appl. No.: 09/860,444

(22) Filed: May 21, 2001

(65) Prior Publication Data

US 2001/0045296 A1 Nov. 29, 2001

Related U.S. Application Data

(60) Provisional application No. 60/205,247, filed on May 19, 2000.

(51) Int. Cl.[7] ..... H01B 7/34; H01B 7/18

(52) U.S. Cl. ..... 174/36; 174/105 R

(58) Field of Search ..... 174/36, 102 R, 174/106 R, 105 B, 110 R, 110 SC, 105 R, 107, 108, 115 R, 117 A, 117 F, 117 FF; 428/77, 189, 343, 344, 346, 347, 354

(56) References Cited

U.S. PATENT DOCUMENTS

| | | | | |
|---|---|---|---|---|
| 3,032,604 A | | 5/1962 | Timmons | |
| 3,624,267 A | * | 11/1971 | Plummer | 156/53 |
| 3,673,315 A | | 6/1972 | Lesley | 174/107 |
| 3,794,750 A | | 2/1974 | Garshick | 174/36 |
| 4,096,346 A | * | 6/1978 | Stine et al. | 174/110 AR |
| 4,150,249 A | * | 4/1979 | Pedersen | 174/103 |
| 4,202,594 A | | 5/1980 | Coleman et al. | 339/147 |
| 4,290,663 A | | 9/1981 | Fowler et al. | 339/143 |
| 4,327,246 A | * | 4/1982 | Kincaid | 174/105 R |
| 4,453,031 A | * | 6/1984 | Justiss | 174/105 B |
| 4,510,346 A | * | 4/1985 | Bursh et al. | 174/106 R |
| 4,621,777 A | | 11/1986 | O'Connor | 242/1 |
| 4,779,328 A | | 10/1988 | Hasegawa et al. | 29/564.4 |
| 4,846,724 A | | 7/1989 | Sasaki et al. | 439/610 |
| 4,855,534 A | | 8/1989 | O'Connor | 174/36 |
| 4,912,283 A | | 3/1990 | O'Connor | 174/36 |
| 5,023,395 A | * | 6/1991 | O'Connor | 156/202 |
| 5,110,999 A | | 5/1992 | Barbera | 174/36 |
| 5,132,491 A | * | 7/1992 | Mulrooney et al. | 174/105 SC |
| 5,144,098 A | * | 9/1992 | VanDeusen | 174/102 SC |
| 5,149,915 A | | 9/1992 | Brunker et al. | 174/36 |
| 5,170,318 A | | 12/1992 | Catala et al. | 361/323 |
| 5,208,426 A | * | 5/1993 | Kennedy et al. | 174/102 SC |
| 5,329,064 A | * | 7/1994 | Tash et al. | 174/106 R |
| 5,434,354 A | * | 7/1995 | Baker et al. | 174/106 R |
| 5,486,649 A | * | 1/1996 | Gareis | 174/10 |
| 5,558,539 A | | 9/1996 | Lignelet | 439/610 |
| 5,713,748 A | | 2/1998 | Mulvihill | 439/98 |
| 5,767,449 A | | 6/1998 | Gronowicz, Jr. | 174/78 |
| 6,166,326 A | * | 12/2000 | Nakajima | 174/36 |
| 6,259,019 B1 | * | 7/2001 | Damilo et al. | 174/102 R |

FOREIGN PATENT DOCUMENTS

| | | | | |
|---|---|---|---|---|
| EP | 0 860 836 A | * | 2/1997 | H01B/11/10 |
| EP | 0860836 | | 8/1998 | |

* cited by examiner

*Primary Examiner*—William H. Mayo, III
(74) *Attorney, Agent, or Firm*—Gilberto M. Villacorta; Andrew J. Bateman; Katten Muchin Zavis Rosenman

(57) ABSTRACT

An electrical cable includes one or more conductors with one or more shields encircling the one or more conductors. Each of the shields includes a conductive layer with a nonconductive layer electrically separating the conductive layer from one another. Connection mechanisms to the conductive layers can be through the use of a plurality of drainwires, which are each in substantially continuous contact with one conductive layer of at least one shiel. Each of the connection mechanisms is eletrically separated from other conductive layer of other shields and from the other connection mechanisms. Each connection mechanism and conductive layer in contact therewith can constitute an electrode that is electrically connectable at an end of the cable.

31 Claims, 5 Drawing Sheets

MULTIPLE SHIELDED CABLE

This application claims priority under 35 U.S.C. §119(e) to U.S. Provisional Application No. 60/205,247, filed on May 19, 2000.

FIELD OF THE INVENTION

The present invention relates generally to electrical cables. More particularly, the present invention relates to shielded electrical cables capable of preventing radiation from signals contained within, while also avoiding the creation of undesirable ground loops. In general, ground loop formation is an unintentional side effect of the process of cable shield connection to the terminating devices.

BACKGROUND OF THE INVENTION

The use of shielded electrical cables for establishing suitable electromagnetic compatibility (EMC) margins in commingled communications, or other electronic equipment environments, is nearly ubiquitous. In such equipment settings, isolated single purpose connections are commonly utilized to bond conductive equipment shells to supporting frames and structures, and then through these, to earth or ground potential. This is primarily done to prevent hazardous voltage differences from developing between the exposed surfaces of the various entities so interconnected, and to improve signal integrity between equipment communicating over an electrical path. Nonetheless, easily measurable, and operationally problematic, voltage differences can result from any number of a variety of factors such as, for example, local fault currents, or external influences such as lightning, power system induction or faults, or even the ramifications of ambient magnetic disturbances created by solar storms.

In an effort to achieve suitable EMC margins, a shield conductor of a connecting cable is frequently connected at each end to an equipment shell. This practice, however, leads to the undesirable result of creating a complete electrical loop, which in the present context, is called a ground loop. Specifically, in this example, the ground loop consists of the preexisting equipment bonding mechanisms and the interconnecting cable shield. FIG. 1 provides a schematic representation of this condition. In FIG. 1, cable shield 10 is connected at opposite ends to a first equipment shell 12 and a second equipment shell 14, and thereby to area bonding network 16 to form a complete electrical loop or ground loop 18.

Often, the effects of the group loop are benign because there is little or no potential difference between cable ends, as a result of no external currents and a relatively small loop area as defined by the enclosing ground loop path. In other cases, however, a ground loop formed incidentally by the shield connections of the cable can create serious problems. For example, even though potential differences can be controlled by bonding system design to no more than a few volts, such a voltage can produce unintended cable shield currents of many amperes. This unintended current can, in turn, induce disturbances in other proximally located cables and, due to imperfections of shield construction, disturb the signals carried within the offending cable itself. Unreliable communication between interconnected equipment can result, and in rare instances, destructive levels can occur.

Therefore, because it is difficult to establish the immediate and future ramifications of incidental cabling ground loops, the routine creation of ground loops is to be avoided. Present practice is to avoid the creation of cable shielding ground loops by establishing a shield connection at only one end of the subject cable. By doing so, the continuous ground loop may be broken and the incidental and unwanted current flow in the shield interrupted.

This solution, however, is contrary to EMC best practices. In this regard, connecting the cable shielding at only one end of the cable gives rise to a number of other problems. These, in particular, include signal leakage radiation, and susceptibility to external radio frequency and other electromagnetic ambient conditions. To elaborate, shielding is used when it is desirable to prevent conducted signal leakage and resultant radiation from cabling. In a reciprocal manner, external electromagnetic fields are intended to induce currents on the cable shield, as opposed to the signal conductors contained within. Any discontinuity in the shield, such as intentionally disconnecting one end from the equipment shell at that end, to interrupt a ground loop path, for example, allows a voltage differential to develop across the discontinuity, with attendant undesirable coupling between external fields and the intentional signal currents.

To this date, the devices of the prior art have not been effective in addressing these and other problems. Current cabling designs alone cannot directly satisfy the contradictory goals of providing a continuous, and thus potentially effective, radio frequency (RF) shielding, and in the same instance, provide a discontinuous ground path, thus avoiding the formation of a ground loop. A well known, but rarely practiced solution because of induced mechanical complexities, and consequent cost penalties in equipment design, is to incorporate a discrete capacitor which is in series between the conductive equipment shell and each of the corresponding cable end shield connection means, in at least one of the devices to be interconnected, taken two at a time. For this purpose, a blocking capacitor typically in the order of 0.1 microfarads is selected, which must, along with its mounting means, possess very low stray inductive and resistive effects to avoid materially affecting shield RF performance as a result of its introduction.

A typical prior art cable 20 used for telecommunications equipment interconnections, which employs a metallized film shielding means is shown in cross-section in FIG. 2A. The metallized film used as the shield itself is shown in cross-section in FIG. 2B. Referring first to FIG. 2B, shield 28 is composed of a strip of nonconductive or insulating material 44 with a metallized layer 48 formed on one side. Referring next to FIG. 2A, shield 28 is helically or longitudinally wrapped around a plurality of conductors or signal leads 24. One edge of the metallized film shield, essentially parallel to the cable axis, is folded 40 so that when the shield material is formed around leads 24 and overlapped, the metallized surfaces so overlapped connect, forming an electrically continuous shield circumferentially. An uninsulated wire or drainwire 36, in turn, is wound in a widely spaced helix around shield 28 along its entire length in such a manner that it is in continuous contact with metallized outer layer 48. Drainwire 36 serves the purpose of mitigating the effects of the unavoidable shield seam, and when exposed at each cable end, provides a convenient means of connection to the cable shield. An insulating jacket 38 surrounds the shield 28 and the drainwire 36.

As in the case with this and any other form of shielded cable lacking isolation, connection of the shield to equipment enclosure at both ends in an environment where the enclosures are otherwise connected, in most instances by a grounding network, undesirably creates a ground loop.

Thus, prior art does not provide an economical or routine way to achieve simultaneously good cable RF shielding and avoidance of ground loop creation during interconnection of electronic equipment. Consequently, a need exists for a cabling mechanism which directly and economically addresses both performance goals at one time.

SUMMARY OF THE INVENTION

To address these and other needs of the prior art, it is an object of the present invention to provide a shielded cable capable of connecting, communications equipment in a manner that avoids the formation of undesirable ground loops while also avoiding signal radiation and unwanted external radio frequency and electromagnetic interference.

It is another object of the present invention to provide a shielded cable that incorporates a blocking capacitor within the shield construction itself.

It is yet another object of the present invention to provide a shielded cable that possesses the characteristics of capacitively coupled yet electrically isolated parallel shield surfaces.

It is yet another object of the present invention to provide a shielded cable which may be implemented utilizing, for example, simply constructed and applied shield material To meet these and other objects, the present invention provides an electrical cable which includes one or more conductors; at least one shield encircling the at least one conductor, the shield extending along a length of the cable, each shield comprising at least one conductive layer separated electrically from at least another conductive layer by at least one nonconductive layer; and a plurality of connection mechanisms to the at least one conductive layer, each of the connection mechanisms being in substantially continuous contact with the at least one conductive layer of the at least one shield and being electrically separated from other conductive layers of other shields and from other connection mechanisms of said plurality of connection mechanisms, each of the connection mechanisms and each at least one conductive layer in contact therewith comprising one electrode of a plurality of electrodes electrically connectable at an end of the cable.

In one embodiment of the present invention, the electrodes of the electrical cable are electrically insulated from one another. Thus, the conductive layer of each of the shields is electrically separated from the conductive layers of other shields. Furthermore, each electrode may be connected to equipment at one end, with adjacent electrodes being connectable at an opposite end.

In another embodiment of the present invention, the cable includes two or more shields, with each shield and connection mechanism in contact therewith being connectable at one end of the cable and being positioned adjacent only shields and connection mechanisms connectable at an opposite end thereof.

In yet another embodiment of the present invention, each of the one or more shields may include one shield which has one nonconductive layer and two conductive layers formed thereon, with the nonconductive layer separating the two conductive layers. A related embodiment of the present invention includes shields comprised of a first tape and a second tape, each of the first tape and the second tape including a nonconductive layer and a conductive layer, the shield being arranged with the nonconductive layer of the first tape facing the nonconductive layer of the second tape. The second tape may also be oriented with the conductive surface of the second tape facing the nonconductive surface of the first tape, to provide increased inter shield capacitance per unit length and provide for one exposed surface of the shield assembly to be nonconductive, as desired.

In still another embodiment of the present invention, circumferential electrical continuity is facilitated by a first fold extending along a first end edge of the shield with the conductive layer facing outwardly and a second fold extending along a second end edge of the shield with another conductive layer facing outwardly, wherein the outwardly facing portion of the first end edge is in substantially continuous contact with a portion of the conductive layer spaced apart from the first end edge at a first predetermined position, thereby facilitating circumferential electrical continuity in the conductive layer, and wherein the outwardly facing portion of the second end edge is in substantially continuous contact with a portion of the another conductive layer spaced apart from the second end edge at a second predetermined position, thereby facilitating circumferential electrical continuity in the another conductive layer.

In contrast to the above embodiment, in another embodiment, the shields of the electrical cable include a first fold extending along a first end edge of the shield with the nonconductive layer facing outwardly, the outwardly facing portion of the first end edge separating the conductive layer from contact with other conductive layers of other shields.

In still other embodiments, the one or more conductors are grouped into two or more bundles of conductors, with each bundle of conductors being encircled by at least one shield of the one or more shields. Similarly, each bundle of the two or more bundles may just as easily be encircled by two or more shields, or encircled by one shield with all of the bundles in turn being encircled by another shield.

In yet other embodiments of the present invention, one or more of the conductive layers of the one or more shields includes a predetermined loss sufficient to control resonant effects introduced as a function of the exact cable length utilized. In contrast, in further embodiments, each nonconductive layer of the one or more shields includes a predetermined loss sufficient to control resonant length effects.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS

In accordance with the principles of the present invention, a shielded electrical cable capable of preventing signal radiation while also avoiding the generation of undesirable ground loops is disclosed. More particularly, the shielded electrical cable of the present invention includes one or more conductors and one or more shields encircling the conductors. Each of these shields includes a conductive layer and a nonconductive layer electrically separating each of the conductive layers from one another. In addition, the shielded electrical cable also includes a plurality of drainwires or other connection mechanisms to the plurality of conductive layers. In the case of drainwires, they are in turn, each in substantially continuous contact with one conductive layer of at least one shield, as well as electrically separated from other conductive layers of other shields and other drainwires. Each drainwire and conductive layer in contact therewith then includes an electrode which is electrically connectable at an end of the cable. With this combination, the shielded electrical cable of the present invention prevents signal radiation while also avoiding the generation of undesirable ground loops.

Figure 1:
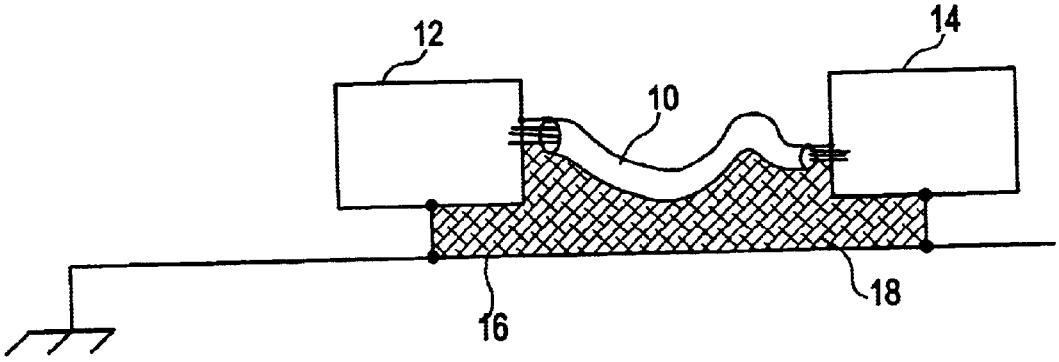
FIG. 1 PRIOR ART
FIG. 1 is a schematic representation of a ground loop formed between two communications equipment shells.
Figure 2A:
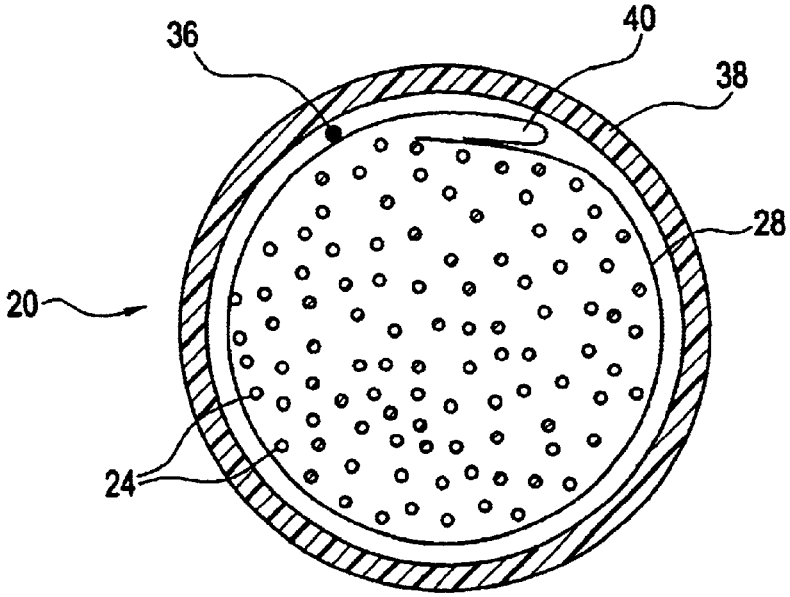
FIG. 2A PRIOR ART
FIG. 2A is a cross sectional view of a prior art shielded electrical cable.
Figure 2B:
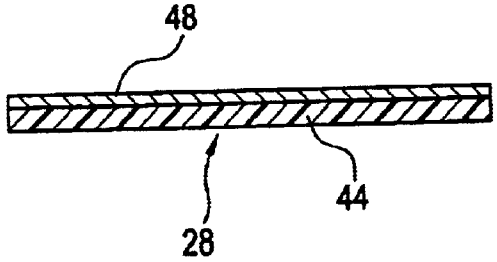
FIG. 2B PRIOR ART
FIG. 2B is a cross sectional view of a shield utilized in the electrical cable of FIG. 2A.
Figure 3:
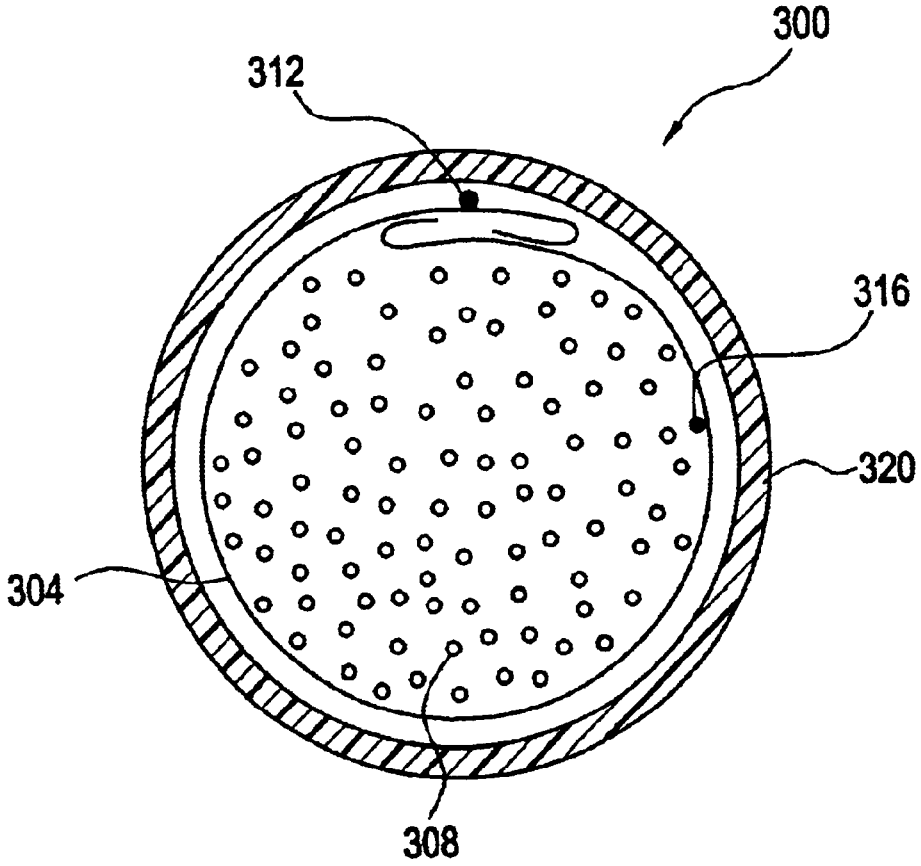
FIG. 3 is a cross sectional view of one embodiment of a shielded electrical cable of the present invention.

Referring to FIG. 3, a cross sectional view of one example of a shielded electrical cable 300 implemented in accordance with the principles of the present invention is depicted. As shown in FIG. 3, cable 300 includes a number of elongated signal leads or conductors 308 used for the transmission of signals from one end of cable 300 to the other. Conductors 308, in turn, are encircled, either helically or longitudinally or via any other suitable orientation, by shield 304 substantially along an entire length of cable 300. Surrounding both shield 304 and conductors 308 is an insulating jacket 320, which may be formed of, for example, plastic or any of a number of other suitable materials. As will be described below, insulating layer 430 may be formed of any one of a number of materials, for example, a plastic such as polyethylene-terephthalate (mylar).

Figure 4:
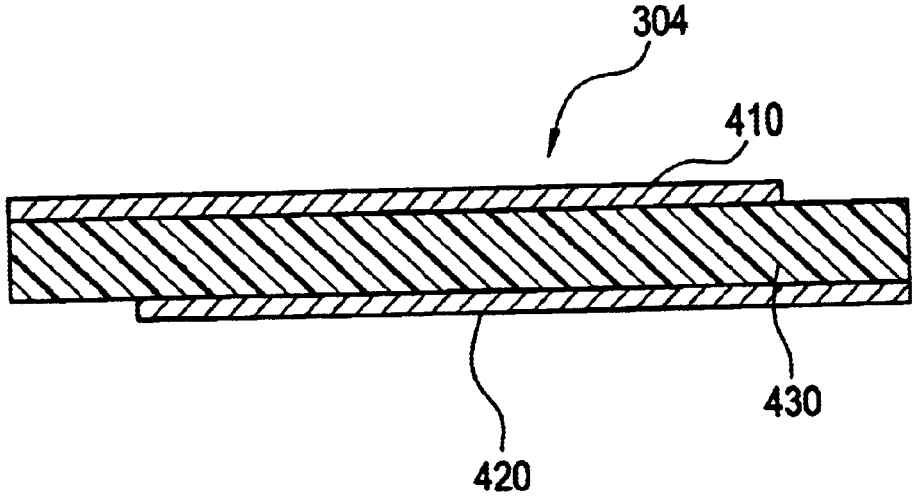
FIG. 4 is a cross sectional view of one example of a shield for use with the present invention, with partially underlapped metallization layers applied to opposing surfaces of an insulating film.

FIG. 4 depicts a cross sectional view of one example of shield 304. In this example, shield 304 includes a single insulating or dielectric layer 430. For use as conductive shields, a layer of metallization 410, 420 is formed on each surface of insulating layer 430. Thus, insulating layer 430 electrically separates layer of metallization 410 from layer of metallization 420. Insulating layer 430 may be formed of any one of a number of materials, such as for instance plastic, polyethylene-terephthalate (mylar) or any other suitable materials. The layers of metallization 410, 420, on the other hand, are typically formed of aluminum, or the like, and may be formed or laminated onto insulating layer 430 through any suitable process, such as for instance, a sputtering technique or a vapor deposition technique. Furthermore, although the layers of metallization 410, 420 are shown as being laminated to insulating layer 430, it is to be understood that the layers of metallization may just as easily exist as distinct elements freely moveable with respect to insulating layer 430. Therefore, with this construction, the layers of metallization are electrically separated from one another allowing the shield structure to impede any unwanted ground currents, while at the same time maintaining a large capacitance between the layers of metallization to provide a low impedance for radio frequency (RF) currents.

Referring again to FIG. 3, a first or inner drainwire 316 and a second or outer drainwire 312 extend substantially helically or longitudinally (or via some other suitable orientation) along the entire length of cable 300. In this particular embodiment, drainwires 312 and 316 are uninsulated and are in substantially continuous electrical contact with the layers of metallization 410 and 420, respectively, of shield 304. This combination of metallized layer and drainwire thus forms an electrode which may be connected to, for example, an equipment shield at either end of cable 300. Advantageously, drainwires 316 and 312 mitigate any effects of the shield fold seam.

The drainwires also provide, for example, a convenient method of electrical connection to equipment shields at each end of cable 300. Thus, by connecting drainwire 312 at a first end of cable 300 and drainwire 316 at the other end of cable 300 the formation of a ground loop may be avoided. Insulating layer 430, along with layers of metallization 410 and 420, in essence form an unrolled capacitor with the two drainwires 316, 312 forming the opposing plate connections. As a result, the cabling intrinsically embodies a high quality distributed RF capacitor that does not require connection at both ends of the cable 300 of either drainwire, but only a connection at one end to a first drain wire and a connection at another end of a second drainwire. In addition, the combination of elements described above results in not only a shielded cable which incorporates a blocking capacitor within the shield construction itself, but also a shielded cable which possesses the characteristics of capacitively coupled yet electrically isolated parallel shield surfaces.

As should be apparent from the discussion above, numerous processes and constructions may be used to implement shield 304. As an example, one or more insulating overhangs (see FIG. 4 and further below with respect to FIG. 5A) may optionally be formed on, for example, one or more longitudinal edges of shield 304. This construction is particularly useful for providing additional electrical clearance between distinct conductive surfaces of one or more shields. Specifically, the nonconductive overhang may be formed by cutting or etching (or any other suitable mechanical, chemical or electromechanical fabrication process or the like) the conductive portions from the underlying nonconductive layer. Similarly, the conductive layer may be selectively applied to an underlying layer in a manner that produces an overhang. In this manner, one or more overhangs of nonconductive material are formed, which in turn provide additional nonconductive clearance between the conductive layers.

Although in the example described above shield 304 is depicted as including a single insulating layer with metallized layers formed on each of its surfaces, cable 300 may utilize any number of shields. Indeed, the single and two piece implementations of any one shield are substantially identical so long as the dielectric properties of the insulating materials are identical, and the sum of the thicknesses of the individual insulating layers is equal to the thickness of the insulator in the single layer embodiment. For example, referring to FIG. 5A, shield 304*a* may just as easily be comprised of two distinct strips 510 and 520.

Figure 5A:
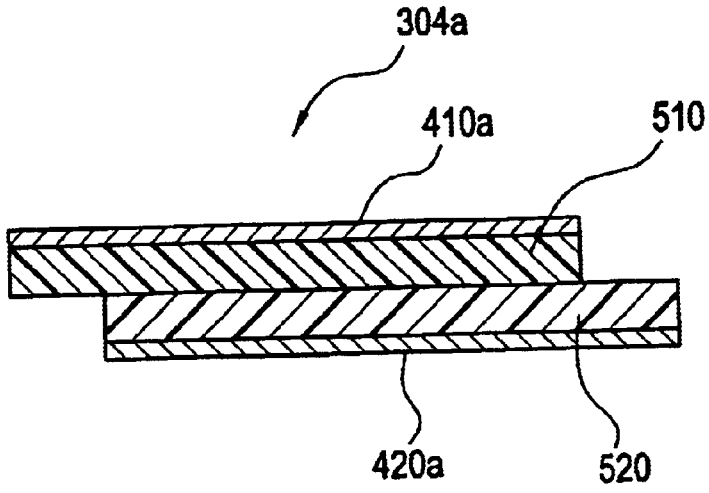
FIG. 5A is a cross sectional view of one example of a shield for use with the present invention, composed of two layers of insulating film, each with one surface uniformly coated with metallization.

In FIG. 5A, shield 304*a* is formed of a first insulating strip or tape 510 and a second insulating strip or tape 520. Each insulating strip 510, 520, in turn, has a metallized layer 410*a*, 420*a*, respectively, formed on one of its surfaces. Furthermore, although the insulating layers are positioned facing one another in this example, they may just as easily be facing inwardly or outwardly so long as the metallized layers 410*a*, 420*a* are electrically separated from one another. In addition, the strips 510, 520 may be laminated or adhered to one another or they may be mechanically independent of one another. As an optional feature, as shown in FIG. 5A, each distinct strip 510 or 520 may be offset from the other strip 510 or 520 to form an overhang providing additional electrical clearance for the metallized layers 410*a*, 420*a*.

Figure 5B:
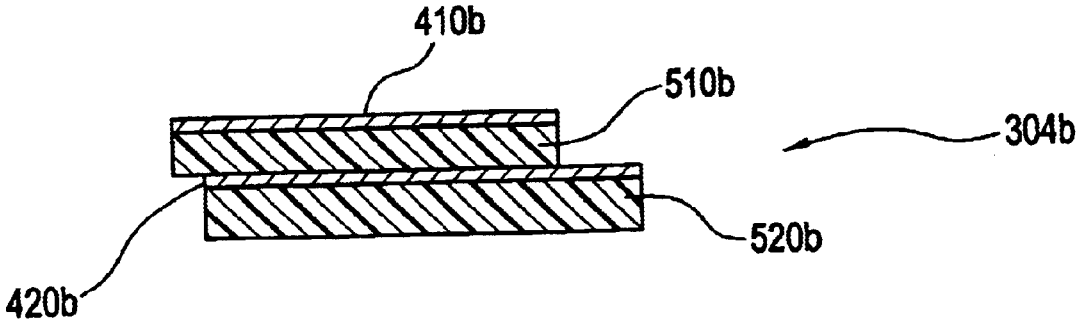
FIG. 5B is a cross sectional view of another example of a shield for use with the present invention, composed of two layers of insulating film, each with one surface uniformly coated with metallization.

As mentioned above, the particular orientations and placements of the layers of metallization can be varied without departing from the principles and scope of the present invention. Hence although FIG. 5A depicts a metallized layer 420*a* facing inwardly and separated from an outwardly facing outer metallized layer 410*a* by intermediate insulating layers 510 and 520, other implementations are possible. For example, as depicted in FIG. 5B, shield 304*b* may just as easily have an inwardly facing insulating layer 520*b* having thereon an intermediate metallized layer 420*b*, and an intermediate insulating layer 510*b* having an outwardly facing metallized layer 410*b*.

Likewise, again referring to FIG. 5B, the assignment of inwardly and outwardly facing surfaces may be exchanged so that metallization layer 410*b* faces inwardly, and the insulating material 520*b* faces outwardly. In each of these examples the metallized layers are separated from one another by one or more insulating layers and are in substantially continuous electrical contact with a drainwire. Furthermore, each metallized layer and drainwire in contact therewith, for example, is connectable at one end of the cable and is positioned adjacent only to shields and drainwires connectable at an opposite end thereof.

Advantageously, more than one shield of the construction described above may be utilized. Thus, although the examples described above utilize a single shield pair, it is to be understood that two or more composite shields may be implemented with the advantage of even further reducing field leakage. For instance, any number of metallized layers may be utilized with odd numbered layers in parallel at one end and even numbered layers in parallel at an opposite end. This interdigitation of multiple shields could also be employed if a higher intershield capacitance per unit length is desired.

In accordance with the principles of the present invention, the end edges of the shields may optionally be folded to, for example, ensure circumferential electrical continuity and to provide nonconductive clearance between conductive layers. In this manner, complete shield coverage is achieved and as a result, leakage radiation is minimized. Specifically, referring to FIG. 6 one example of a fold detail utilizable in the cable 300 of the present invention is depicted.

Figure 6:
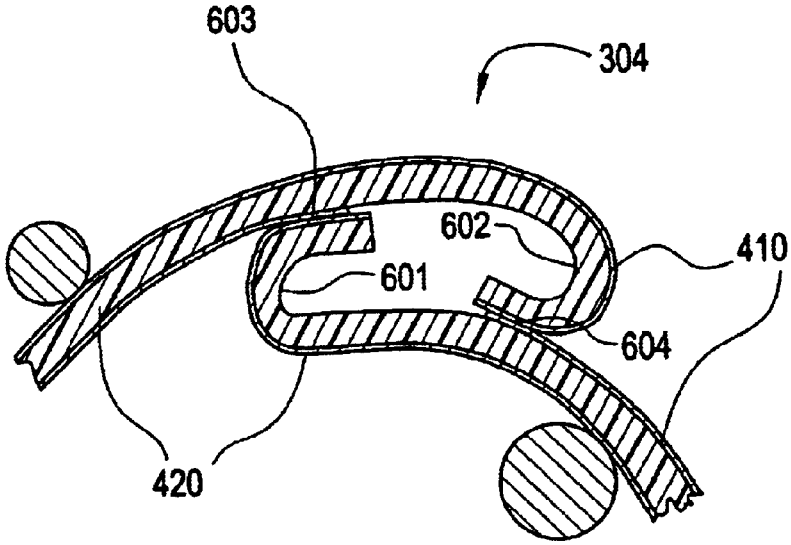
FIG. 6 is a cross sectional fold detail of one example of the shielded electrical cable of the present invention.

In FIG. 6, a shield 304 has conductive or metallized layers 410, 420 on each side of the nonconductive layer. The metallized or conductive layer 410 is facing outwardly, and the metallized or conductive layer 420 faces inwardly.

A first elongated fold 601 extends along a first end edge of shield 304 having a first metallized or conductive layer 410 facing outwardly. The outer metallized or conductive layer 410 does not extend along the first end edge of the shield 304. Similarly, a second fold 602 extends along a second elongated end edge of shield 304 having the metallized or conductive layer 410 thereon also facing outwardly. The inner metallized or conductive layer 420 does not extend to the second end edge of the shield 304. Thus, the inner portions of the folds 601, 602 are not metallized.

The outwardly facing portion of the first end edge at the fold 601 is in substantially continuous contact with a portion of the inwardly facing conductive or metallized layer 420 which is spaced apart from the second end edge at position 603, thereby facilitating circumferential electrical continuity in metallized or conductive layer 420. Likewise, the outwardly facing portion of the second end edge at the fold 602 is in substantially continuous contact with a portion of the outwardly facing metallized or conductive layer 410 spaced apart from the first end edge at position 604, thereby facilitating circumferential electrical continuity in metallized or conductive layer 410.

Figure 7:
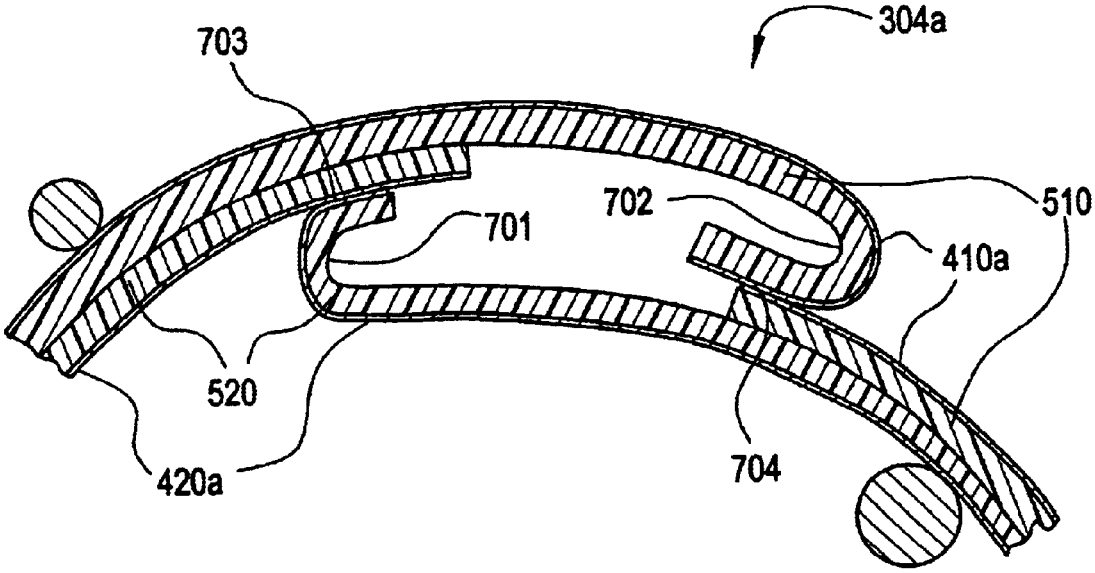
FIG. 7 is another cross sectional fold detail of one example of the shielded electrical cable of the present invention.

FIG. 7 illustrates an example of the folds implemented with a two piece shield as described above. The two piece shield includes a strip 510 and a strip 520 which are layered on each other, or fixed on each other by any suitable means. Strip 510 is the outer strip, and strip 520 is the inner strip of the two piece shield. The strips 510, 520 are offset to produce an overhang, such that at the first end edge, inner strip 520 extends past outer strip 510, and at the second end edge, outer strip 510 extends past inner strip 520.

A first fold 701 extends along a first end edge of the overhang of strip 520 of the two piece shield 304*a*, with a first metallized or conductive layer 420*a* facing inwardly. Strip 510, is layered on an inner surface of the strip 520 of the first piece of the two piece shield, but does not extend proximate to the first fold 701 of strip 520. Strip 510 has a metallized or conductive layer 410*a* thereon facing outwardly.

Similarly, a second fold 702 extends along a second end edge of strip 510, a second piece of the two piece shield 304*a*, with an opposing metallized or conductive layer 410*a* also facing outwardly. Strip 520 is layered on an inner surface of the strip 510 of the second piece of the two piece shield, but does not extend proximate to the second fold 702 of the strip 510. Strip 520 has a metallized or conductive layer 420*a* thereon facing inwardly.

The outwardly facing portion of the first end edge of strip 520 of a first piece of the two piece shield 304*a*, is in substantially continuous contact with a portion of the conductive or metallized layer 420*a* of the strip 520 of the first piece of the two piece shield 304*a*, at a position 703, thereby facilitating circumferential electrical continuity in metallized or conductive layer 420*a*. Likewise, the outwardly facing portion of the second end edge of strip 510 of the second piece of the two piece shield 304*a* is in substantially continuous contact with a portion of metallized or conductive layer 410*a* at position 704, thereby facilitating circumferential electrical continuity in metallized or conductive layer 410*a*.

Figure 8:
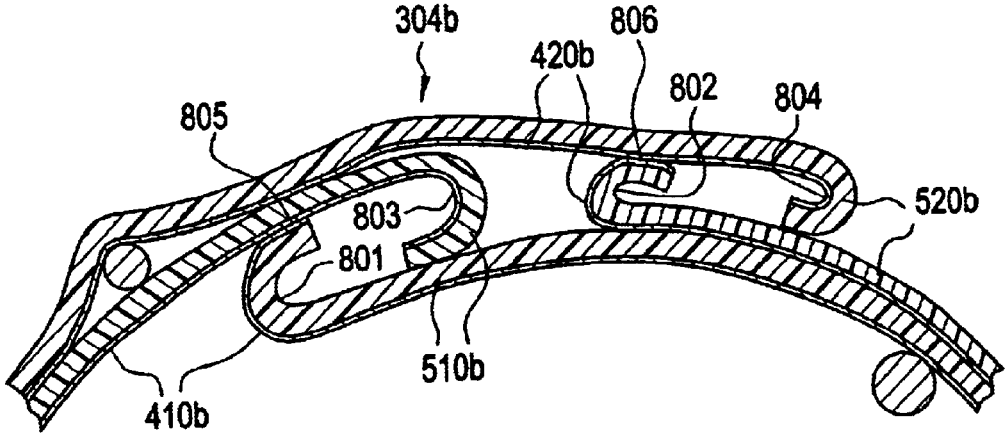
FIG. 8 is yet another cross sectional fold detail of one example of the shielded electrical cable of the present invention.

Alternatively, the end edges of the strips 520 and 510 of the first and second pieces of the two piece shield 304*a*, may be formed with the conductive or metallized surface facing inwardly and the nonconductive or dielectric layer facing outwardly. In this manner, a metallized surface and the resultant electrode may be better insulated. For instance, FIG. 8 depicts an example of the folds implemented in the shield of FIG. 5B, so that the exposed metallized surface of the layered shield 304*b* faces inwardly. In particular, a first fold 801 extends along a first edge of strip 510*b* of a first piece (includes layered strips 510*b* and 520*b*) of a two piece shield 304*b*, such that metallized layer 410*b* thereon faces outwardly. This outwardly facing portion of 410*b* is in substantially continuous contact with a portion of metallized layer 410*b* at a second edge of strip 510*b* (includes layered strips 510*b* and 520*b*) of the two piece shield 304*b*, at position 805, thereby facilitating circumferential electrical continuity in metallization or conductive layer 410*b*.

Similarly, a second fold 802 extends along a second edge of strip 520*b* of the second piece of the two piece shield 304*b*, with metallization layer 420*b* thereon facing outwardly, and with metallization layer 420*b* being in substantially continuous contact with a portion of metallization layer 420*b* on strip 520*b* of the second piece of the two piece shield 304*b*, at position 806, to facilitate circumferential electrical continuity in metallized layer 420*b*.

In contrast, a third fold 803 extends along a third end edge of strip 510*b* of the first piece of the two piece shield 304*b* with insulating or nonconductive layer 510*b* facing inwardly. Like fold 803, a fourth fold 804 extends along a fourth end edge of strip 520*b* of the second piece of the two piece shield 304*b*, with insulating or nonconductive layer 520*b* facing inwardly. These inwardly facing portions, then, face respective portions of nonconductive layers 510*b* and 520*b* and are spaced apart from the end edges of the opposing nonconductive layers 510*b* and 520*b*. Thus the conductive or metallized layers 410*b* and 420*b* are separated from contact with other conductive or metallized layers of other shields. Consequently, folds 801 and 802 ensure electrical continuity while folds 803 and 804 insulate metallized layers from one another. Furthermore, with any of the above examples, the folds and drainwires may be located in any angular position.

In an alternate embodiment, the above described conductors may be grouped into a number of bundles, each of which may be encircled by one or more shields according to the techniques of the present invention. Any number of these shielded bundles may, in turn, be encircled by one or more additional shields and optionally by an outer insulating jacket. By selecting the insulating surface of the shield strips for each individual bundle to be oriented outwardly, and shield isolation between individual bundles with an overall cable is advantageously achieved without the requirement for additional insulation layers. Such a cable is particularly useful for installations which require the individual bundles, at either or both ends, to fan out to divergent equipment locations for interconnection. Likewise, this cable may also be useful where, for example, at most, one end of the cable is required to have the individual bundles fan out to divergent locations.

Figure 9:
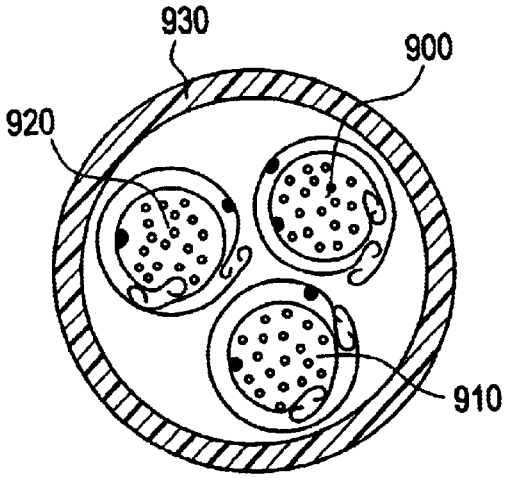
FIG. 9 is a cross sectional view of an alternate embodiment of a shielded electrical cable of the present invention.

As one example, FIG. 9 depicts three individual bundles 900, 910, and 920 encircled by an outer insulating jacket 930. More specifically, each of bundles 900, 910 and 920 is implemented utilizing, for example, two shields which are folded at the end edges in the arrangements specified above. Furthermore, in this particular example the metallized layers of the shields are facing inwardly and are separated by at least one insulating or nonconductive layer. In addition, it is important to note that different and additional shield arrangements may be utilized by each of the bundles.

Figure 10:
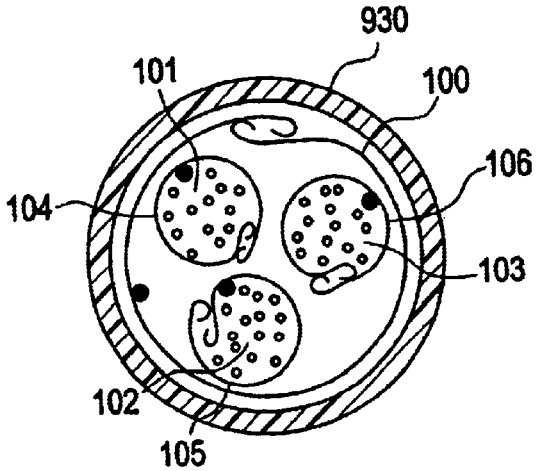
FIG. 10 is a cross sectional view of an other alternate embodiment of a shielded electrical cable of the present invention.

Referring to FIG. 10, another embodiment of the present invention includes an outer shield 100 common to all bundles within. In this embodiment, each bundle 101, 102, 103 is encircled first by its own inner shield 104, 105, 106. In this case, the inner shields 104, 105, 106 are arranged with the metallized layer facing inwardly. Then, a single outer shield 100, also with the metallized layer facing inwardly, is used to encircle each of the bundles 101, 102, 103. Again, like the embodiment described above, different and additional shield arrangements may be utilized by each of the bundles 101, 102, 103.

In each of the embodiments of FIGS. 9 and 10, the electrodes formed by the metallized layer and drainwire combination are electrically insulated from one another. Furthermore, each of these electrodes is connectable at one end and positioned adjacent electrodes connectable at an opposite end.

As mentioned above, any of a number of materials may be utilized in the construction of insulating layer 930. As discussed, one suitable example is mylar. Such material, and the like, are desirable for their exceptional mechanical properties as well as because above 1 MHz they also possess significant electrical loss. In this regard, some shield dielectric loss is needed to reduce the undesirable effects of intershield resonances, the frequencies of which are determined by specific cable lengths as the closely spaced isolated shield layers behave as extremely low impedance transmission lines. Advantageously, additional distributed loss may be added, in the form of a resistive component, such as for example, carbon black or the like, introduced into the insulating material. Alternatively, the loss per unit cable length associated with the resistivity of one or more metalized shield layers, which can be adjusted by controlling metallization thickness and composition, may be used to damped intershield resonances.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electrical cable, comprising:

at least one conductor;

at least one shield encircling said at least one conductor, said at least one shield extending along a length of the electrical cable, each shield of said at least one shield comprising a first conductive layer separated electrically from at least a second conductive layer by at least one nonconductive layer, wherein each shield of said at least one shield is comprised of a first tape and a second tape, each of said first tape and said second tape comprising a nonconductive layer and a conductive layer, said at least one shield being arranged with said nonconductive layer of said first tape facing said conductive layer of said second tape;

a first connection mechanism electrically connected to said first conductive layer; and at least a second connection mechanism electrically connected to said at least second conductive layer, each of said first and at least second connection mechanisms being in substantially continuous electrical contact with said first and at least second conductive layers of said at least one shield, respectively, and being electrically separated from other conductive layers of other shields and from other connection mechanisms, each of said first and at least second connection mechanisms and each of said first and at least second conductive layers in electrical contact therewith, respectively, comprising one electrode of a plurality of electrodes electrically connectable at an end of said electrical cable, wherein a first fold extends along a first overhang at a first end edge of said first tape, a second fold extends along a second overhang at a second end edge of said second tape, a third fold formed from said first tape first end edge overhangs extends at a position independent of said first end edge of said first tape, and a fourth fold formed from said second end edge overhang of said second tape extends at a position proximate said second end edge of said second tapes, wherein an outwardly facing conductive portion of said first fold at said first end edge of said first tape is in substantially continuous electrical contact with a portion of an inwardly-facing conductive portion of said conductive layer of said first tape at said first fold, thereby facilitating circumferential electrical continuity in said conductive layer proximate another end edge of said first tapes, wherein an outwardly facing conductive portion of said second fold at said second end edge of said second tape is in substantially continuous electrical contact with a portion of an inwardly-facing conductive portion of said conductive layer of said second tape at said second fold, thereby facilitating circumferential electrical continuity in said conductive layer proximate another edge of said second tapes, wherein said third fold at said first end edge of said first tape outwardly exposes an insulating surface of said first tape, thus electrically separating a conductive surface of said first tape from electrical contact with other conductive layers of other shields, wherein said fourth fold at said second end edge of said second tape outwardly exposes an insulating surface of said second tape, thus electrically separating a conductive surface of said second tape from electrical contact with said other conductive layers of said other shields, and wherein the first fold is separated from the third fold by a first predetermined distance, wherein the second fold is separated from the fourth fold by a second predetermined distance, and the first and third folds are separated from the second and fourth folds by a third predetermined distance.

2. The electrical cable of claim 1, wherein the first tape is offset from the second tape in at least one of the at least one shield, and wherein the nonconductive layer of the first tape provides an additional nonconductive clearance at an edge, and the nonconductive layer of the second tape provides an additional nonconductive clearance at another edge.

3. The electrical cable of claim 1, wherein the nonconductive layer extends beyond at least one edge of the conductive layer in at least one of the at least one shield, forming at least one overhang of nonconductive material, thereby providing an additional nonconductive clearance between the first and at least second conductive layers of the at least one of the at least one shield.

4. The electrical cable of claim 1, wherein at least one of the first conductive layer and the at least second conductive layer of at least one of the at least one shield includes a predetermined loss sufficient to control resonant length effects.

5. The electrical cable of claim 1, wherein at least one of the at least one nonconductive layer of at least one of the at least one shield includes a predetermined loss sufficient to control resonant length effects.

6. The electrical cable of claim 1, wherein the at least one shield includes one of a sputtering formed, chemical deposition formed, and vapor-deposition formed first and at least second conductive layers.

7. An electrical cable, comprising:

at least one conductor;

at least one shield encircling the at least one conductor, the at least one shield extending along a length of the electrical cable, each of the at least one shield comprising:

a first non-conductive layer;

a first conductive layer formed on the first non-conductive layer to form a first layer of each of the at least one shield;

at least a second non-conductive layer;

at least a second conductive layer formed on the at least second non-conductive layer to form a second layer of each of the at least one shield, wherein the first conductive layer is electrically separated from the at least second conductive layer by the at least second non-conductive layer, and wherein the first conductive layer and the at least second conductive layer face inwardly toward the at least one conductor;

a first fold extending along a first end edge of the first layer;

a second fold extending along a second end edge of the first layer;

a third fold extending along a first end edge of the at least second layer; and a fourth fold extending along a second end edge of the at least second layer, wherein an outwardly-facing portion of the first fold is in substantially continuous electrical contact with a portion of the inwardly-facing first conductive layer at the first fold, thereby facilitating circumferential electrical continuity in the first conductive layer, wherein an inwardly-facing portion of the second fold is in substantially continuous contact with a portion of an outwardly-facing first non-conductive layer at the second fold, wherein an outwardly-facing portion of the third fold is in substantially continuous electrical contact with a portion of the inwardly-facing at least second conductive layer at the third fold, thereby facilitating circumferential electrical continuity in the at least second conductive layer, wherein an inwardly-facing portion of the fourth fold is in substantially continuous contact with a portion of an outwardly-facing at least second nonconductive layer at the fourth fold, wherein the first fold is separated from the second fold by a first predetermined distance, wherein the third fold is separated from the fourth fold by a second predetermined distance, and wherein the first and second folds are separated from the third and fourth folds by a third predetermined distance;

a first connection mechanism electrically connected to the first conductive layer; and at least a second connection mechanism electrically connected to the at least second conductive layer, wherein the first connection mechanism and the at least second connection mechanism are in substantially continuous electrical contact with the first conductive layer and the at least second conductive layer, respectively, and electrically separated from each other and other connection mechanisms, and wherein the first connection mechanism and the first conductive layer in electrical contact therewith comprise a first electrode of a plurality of electrodes and the at least second connection mechanism and the at least second conductive layer in electrical contact therewith comprise a second electrode of the plurality of electrodes, wherein each of the plurality of electrodes is electrically connectable at an end of the electrical cable.

8. The electrical cable according to claim 7, comprising:

an insulating jacket extending along the length of the electrical cable and encircling the at least one conductor, the at least one shield, and the first and at least second connection mechanisms.

9. The electrical cable of claim 7, wherein the at least one conductor is grouped into two or more bundles of conductors, with each bundle of conductors being encircled by at least one shield.

10. The electrical cable of claim 9, wherein each bundle of the two or more bundles is encircled by two or more shields.

11. The electrical cable of claim 9, wherein each bundle of the two or more bundles is encircled by one shield and wherein all of the bundles are encircled by another shield.

12. The electrical cable of claim 7, wherein at least one of the first non-conductive layer and at least second nonconductive layer includes a predetermined loss sufficient to control resonant length effects.

13. The electrical cable of claim 7, wherein the plurality of electrodes are electrically insulated from one another.

14. The electrical cable of claim 7, wherein, when the plurality of electrodes form opposing plate connections, the plurality of electrodes comprises at least one distributed capacitor.

15. The electrical cable of claim 7, wherein when the at least one shield is arranged such that a first group of at least one conductive layers is electrically connected at an electrical cable end, and at least a second disjoint group of adjacent at least one conductive layers is electrically connected at another electrical cable end, the at least second disjoint group being electrically separated from said first group and from other disjoint groups, the at least one shield comprises a blocking capacitor.

16. The electrical cable of claim 7, wherein at least one of the first conductive layer and the at least second conductive layer of at least one of the at least one shield includes a predetermined loss sufficient to control resonant length effects.

17. The electrical cable of claim 7, wherein the first nonconductive layer extends beyond at least one edge of the first conductive layer of at least one of the at least one shield, and wherein the at least second nonconductive layer extends beyond at least one edge of the at least second conductive layer of the at least one of the at least one shield.

18. The electrical cable of claim 7, wherein the first conductive layer is offset from the at least second conductive layer of at least one of the at least one shield, forming at least one overhang of nonconductive material, the at least one overhang of nonconductive material providing an additional nonconductive clearance between the first conductive layer and the at least second conductive layer of the at least one of the at least one shield.

19. The electrical cable of claim 18, wherein the at least one overhang of nonconductive material are formed by removing conductive portions from at least one of the first conductive layer and at least second conductive layer of the at least one of the at least one shield by a removal process, including etching.

20. The electrical cable of claim 7, wherein the at least one shield includes one of a sputtering formed, chemical deposition formed, and vapor-deposition formed first and at least second conductive layers.

21. An electrical cable, comprising:

a plurality of conductors, wherein the plurality of conductors is organized into a plurality of subsets of conductors;

a plurality of shields, wherein each of the plurality of shields encircles a subset of the plurality of subsets of conductors, each of the plurality of shields extending along a length of the electrical cable, wherein each of the plurality of shields comprises:

a first non-conductive layer;

a first conductive layer formed on the first nonconductive layer to form a first layer of each of the plurality of shields;

at least a second non-conductive layer;

at least a second conductive layer formed on the at least second non-conductive layer to form a second layer of each of the plurality of shields, wherein the first conductive layer is electrically separated from the at least second conductive layer by the at least second non-conductive layer, and wherein the first conductive layer and the at least second conductive layer face inwardly toward the subset of the plurality of conductors;

a first fold extending along a first end edge of the first layer;

a second fold extending along a second end edge of the first layer;

a third fold extending along a first end edge of the at least second layer; and a fourth fold extending along a second end edge of the at least second layer, wherein an outwardly-facing portion of the first fold is in substantially continuous electrical contact with a portion of the inwardly-facing first conductive layer at the first fold, thereby facilitating circumferential electrical continuity in the first conductive layer, wherein an inwardly-facing portion of the second fold is in substantially continuous contact with a portion of an outwardly-facing first nonconductive layer at the second fold, wherein an outwardly-facing portion of the third fold is in substantially continuous electrical contact with a portion of the inwardly-facing at least second conductive layer at the third fold, thereby facilitating circumferential electrical continuity in the at least second conductive layer, wherein an inwardly-facing portion of the fourth fold is in substantially continuous contact with a portion of an outwardly-facing at least second nonconductive layer at the fourth fold, wherein the first fold is separated from the second fold by a first predetermined distance, wherein the third fold is separated from the fourth fold by a second predetermined distance, and wherein the first and second folds are separated from the third and fourth folds by a third predetermined distance;

wherein each of the plurality of subsets of conductors comprises:

a first connection mechanism electrically connected to the first conductive layer; and at least a second connection mechanism electrically to the at least second conductive layer, wherein the first connection mechanism and the at least second connection mechanism are in substantially continuous electrical contact with the first conductive layer and the at least second conductive layer, respectively, and electrically separated from each other and other connection mechanisms, wherein the first connection mechanism and the first conductive layer in electrical contact therewith comprise a first electrode of a plurality of electrodes and the at least second connection mechanism and the at least second conductive layer in electrical contact therewith comprise a second electrode of the plurality of electrodes, and wherein each of the electrodes from each of the plurality of subsets of conductors is electrically connectable at an end of the electrical cable.

22. The electrical cable according to claim 21, comprising:

an insulating jacket extending along the length of the electrical cable and encircling the plurality of conductors, the plurality of shields, and the first and at least second connection mechanisms of the plurality of subsets of conductors.

23. The electrical cable of claim 21, wherein at least one of the first non-conductive layer and at least second nonconductive layer of each of the plurality of shields includes a predetermined loss sufficient to control resonant length effects.

24. The electrical cable of claim 21, wherein the plurality of electrodes are electrically insulated from one another.

25. The electrical cable of claim 21, wherein, when the plurality of electrodes from at least one of the plurality of subsets of conductors form opposing plate connections, the plurality of electrodes from the at least one of the plurality of subsets of conductors comprises at least one distributed capacitor.

26. The electrical cable of claim 21, wherein when the plurality of shields is arranged such that a first group of at least one conductive layers from at least one of the subsets of conductors is electrically connected at an electrical cable end, and at least a second disjoint group of adjacent at least one conductive layers from at least one of the subsets of conductors is electrically connected at another electrical cable end, the at least second disjoint group being electrically separated from said first group and from other disjoint groups, the plurality of shields comprises a blocking capacitor.

27. The electrical cable of claim 21, wherein at least one of the first conductive layer and the at least second conductive layer of at least one of the plurality of shields includes a predetermined loss sufficient to control resonant length effects.

28. The electrical cable of claim 21, wherein the first nonconductive layer extends beyond at least one edge of the first conductive layer of at least one of the plurality of shields, and wherein the at least second nonconductive layer extends beyond at least one edge of the at least second conductive layer of the at least one of the plurality of shields.

29. The electrical cable of claim 21, wherein the first conductive layer is offset from the at least second conductive layer of at least one of the plurality of shields, forming at least one overhang of nonconductive material, the at least one overhang of nonconductive material providing an additional nonconductive clearance between the first conductive layer and the at least second conductive layer of the at least one of the plurality of shields.

30. The electrical cable of claim 29, wherein the at least one overhang of nonconductive material are formed by removing conductive portions from at least one of the first conductive layer and at least second conductive layer of the at least one of the plurality of shields by a removal process, including etching.

31. The electrical cable of claim 21, wherein the plurality of shields include one of a sputtering formed, chemical deposition formed, and vapor-deposition formed first and at least second conductive layers.

* * * * *